United States Patent [19]

Takayama

[11] Patent Number: 4,763,038

[45] Date of Patent: Aug. 9, 1988

[54] INCANDESCENT LAMP UNIT

[75] Inventor: Kazushige Takayama, Chigasaki, Japan

[73] Assignee: Ichikoh Industries Limited, Tokyo, Japan

[21] Appl. No.: 63,392

[22] Filed: Jun. 18, 1987

[30] Foreign Application Priority Data

Jun. 20, 1986 [JP] Japan ..... 61-93322[U]

[51] Int. Cl.[4] ..... H01J 5/48

[52] U.S. Cl. ..... 313/318; 313/315; 313/317

[58] Field of Search ..... 313/318, 317, 315, 323, 313/324; 439/615, 616, 744, 816

[56] References Cited

U.S. PATENT DOCUMENTS

| | | | |
|---|---|---|---|
| 3,262,001 | 7/1966 | Rijckeart | 313/318 |
| 4,013,335 | 3/1977 | Varkonyi et al. | 313/318 |
| 4,295,076 | 10/1981 | Eckhardt et al. | 313/318 |
| 4,489,252 | 12/1984 | Eckhardt | 313/318 |

*Primary Examiner*—David K. Moore
*Assistant Examiner*—Michael Razavi
*Attorney, Agent, or Firm*—Foley & Lardner, Schwartz, Jeffery, Schwaab, Mack, Blumenthal & Evans

[57] ABSTRACT

In an incandescent lamp unit, a base assembly of a rectangular section and which holds the pinched portion of the bulb comprises a first and second bases. The first base has formed therein a first opening in which said pinched portion can be introduced and first lug members extending from the edges of the first opening and which abut the upper portion of the pinched portion to limit the latter from moving longitudinally and laterally. On the other hand, the second base is so made as to be attached to the first base and has formed therein a second opening in which the pinched portion can be introduced, and it is also provided with second lug members extending obliquely and downwardly from the second opening and which abut the lower portion of the pinched portion to limit the latter from moving in the vertical plane. Since the second lug members are formed on the second base independently of the first lug members, the length of the arm supporting the pinched portion can be increased independently of the width of the pinched portion, and so the pinched portion can be stably held.

4 Claims, 8 Drawing Sheets

INCANDESCENT LAMP UNIT

BACKGROUND OF THE INVENTION (a) Field of the Invention:

The present invention relates to an incandescent lamp unit for use as an automotive headlight, and more particularly to an incandescent lamp unit of which a glass bulb has formed at the rear end thereof a pinched portion of a rectangular section having two opposite wide side faces and two opposite narrow side faces and which is held by a supporting plate or base made of a resilient metal.

(b) Related Art Statement:

The incandescent lamp units of this type are well known. One of them is disclosed in the Japanese Examined Patent Publication No. 58-12706. FIGS. 1 to 3 show such a conventional incandescent lamp unit of which a bulb 1 has formed at the rear end thereof a single pinched portion 2 which is rectangular in sectional form. As shown in FIG. 2, the pinched portion 2 has wide side faces 21 and narrow side faces 22. A filament 23 is disposed in the sealed inner space of the bulb 1, and lead-in wires 15 connected to the filament 23 are laid as buried in the pinched portion 2, led out at the lower end thereof and connected to terminals 16. The reference numeral 3 indicates a single disk-shaped, bulb-supporting plate or base made of a resilient material. The base 3 has various cuts therein by punching. The cuts inlcude a one extending longitudinally in the center of the base 3 and two small oblique cuts each adjoining the longitudinal cut. Thus, two lugs 6 are formed of which the ends are resiliently engaged each in a recess 17 formed in each of the wide side faces 21 of the pinched portion 2. Also a triangular lug 8 is formed by the oblique cutting at each end of the longitudinal cut in the base 3 and abuts each narrow side face 22 of the pinched portion 2. These lugs 8 are bent down from the base 3 perpendicularly to the axis of the longitudinal cut and thus defines the narrow sides of the elongated opening 7 (longitudinal cut). The pinched portion 2 of the bulb 1 is inserted into the opening 7 in the base 3 and the lugs 6 are elastically engaged on the wide side faces 21, respectively, of the pinched portion 2 while the lugs 8 are engaged on the narrow side faces 22 so that the pinched portion 2 is held in the base 3. The base 3 is fixed to a cylindrical holder 18 by calking or otherwise.

In the conventional incandescent lamp unit, the lugs 6 and 8 which are engaged on the pinched portion 2 to hold the latter are made by working the bulb-supporting plate or base 3 by punching; therefore, the lugs 6 engaged on the wide side faces 21 have the width L thereof limited to approximately a half of the width D of the elongated opening 7 as shown in FIG. 3. The width D is made nearly equal to, or somehow larger than, the distance between the wide side faces, namely, the width of the pinched portion 2. Accordingly, the arm length of the lugs 6, that is, the width L, is substantially limited to about a half of the pinched-portion width, and so the ratio of the arm length of the lugs 6 to the length of the pinched portion 2, namely, the length of the pinched portion 2 along the led-out direction of the lead wide 15, is small. The larger this ratio, the more stably the bulb 1 is held by the base 3, but in the conventional lamp unit in which the lugs 6 are formed by punching the single base 3, there is a problem that the arm length of the lugs 6 cannot be made larger for the aforementioned reason.

SUMMARY OF THE INVENTION

The present invention seeks to overcome the above-mentioned drawbacks of the conventional techniques by providing an incandescent lamp unit of which the bulb can be more stably held by the base.

The present invention also seeks to provide an incandescent lamp unit in which the arm length of the lugs abutting the narrow side faces of the pinched portion can be selected correspondingly to the length of the pinched portion but independently of the width of the pinched portions.

The above objects can be accomplished by providing an incandescent lamp unit comprising a metallic supporting plate or base assembly which supports the pinched portion of a rectangular section having two opposite wide side faces and two opposite narrow side faces, the base assembly being composed of a first base having formed therein a first opening in which the pinched portion is introduced and also having first lug members which extend along the edges of the opening and abut the upper portion of the pinched portion to limit the latter from moving longitudinally and laterally, and a second base mounted on the first base and having formed therein a second opening in which the pinched portion is introduced and also having second lug members which extend along the edges of the opening and abut the lower portion of the pinched portion to limit the pinched portion from moving in a plane perpendicular to the pinched portion, the second base being fixed to a holder, the second lug members being formed on the second base independently of the first lug members so that the arm length of the second lug members can be made, thus permitting to hold the pinched portion stably.

These and other objects and advantages of the present invention will be better understood from the ensuing description made by way of example of the embodiments of incandescent lamp unit according to the present invention with reference to the drawings.

BRIED DESCRIPTION OF THE DRAWINGS

FIGS. 4 to 14 show an embodiment of incandescent lamp unit according to the present invention, of which FIG. 4 is a front view of the incandescent lamp unit;

FIG. 5 is a sectional view taken along the line V—V in FIG. 4;

FIG. 6 is also a sectional view taken along the line VI—VI of FIG. 4;

FIG. 7 is a plan view of the first metallic base;

FIG. 8 is a bottom view of the first metallic base;

FIG. 9 is a sectional view taken along the line IX—IX in FIG. 7;

FIG. 10 is a partially sectioanl veiw from the direction X in FIG. 7;

FIG. 11 is a plan view of the second metallic base;

FIG. 12 is a bottom view of the second metallic base;

FIG. 13 is a sectional veiw taken along the line XIII—XIII of FIG. 11;

FIG. 14 is a view from the XIV direction in FIG. 11;

FIGS. 15 to 17 show a variant of the embodiment shown in FIGS. 4 to 14, of which FIG. 15 is an axial sectional view of the incandescent lamp unit according to the variant of the present invention;

FIG. 16 is a front view showing the upper and lower portions composing the second base;

FIG. 17 is a sectional view of the upper and lower portions of the second base;

DETAILED DESCRIPTION OF THE PREFERRED EMBODIMENTS

Figure 1:
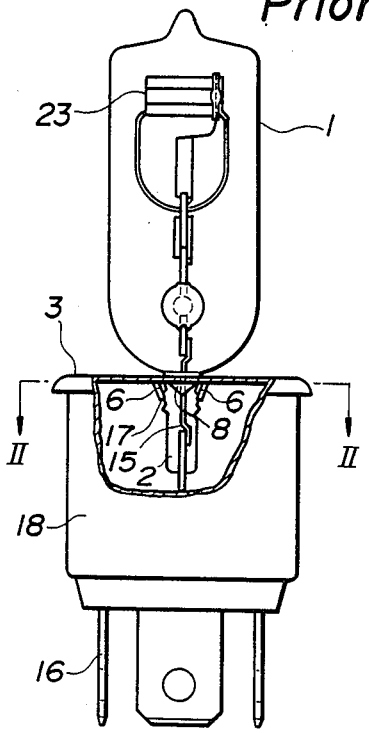
Fig. 1 Prior Art
FIG. 1 is an axial sectional view of a conventional incandescent lamp unit.
Figure 2:
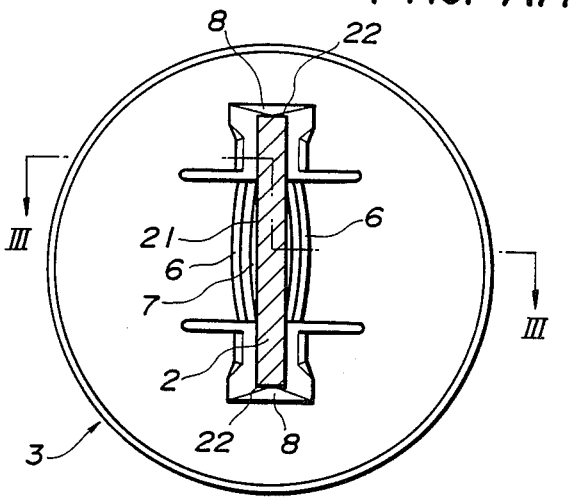
Fig. 2 Prior Art
FIG. 2 is a cross sectional view taken along the line II—II of FIG. 1.
Figure 3:
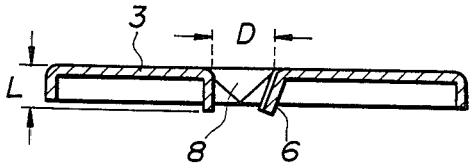
Fig. 3 Prior Art
FIG. 3 is a sectional view taken along the line III—III of FIG. 2.
Figure 4:
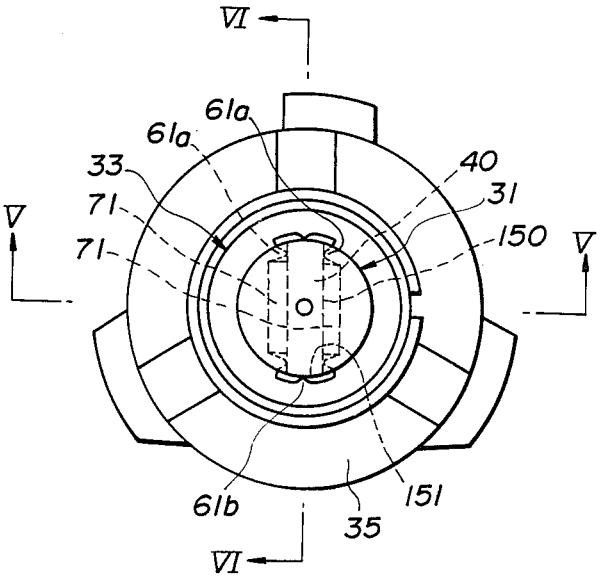
Figure 5:
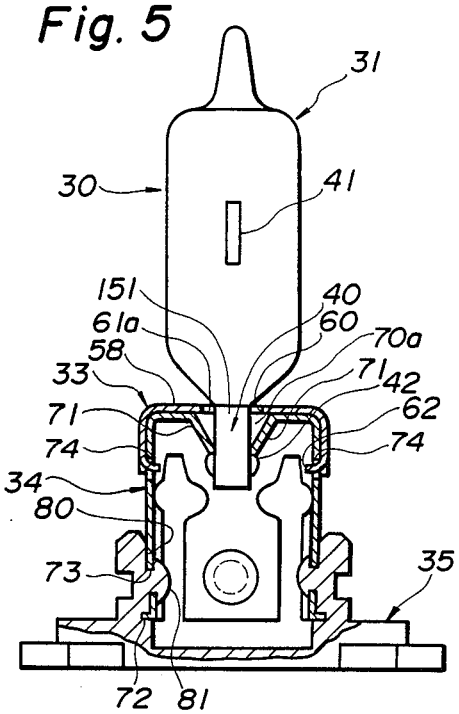
Figure 6:
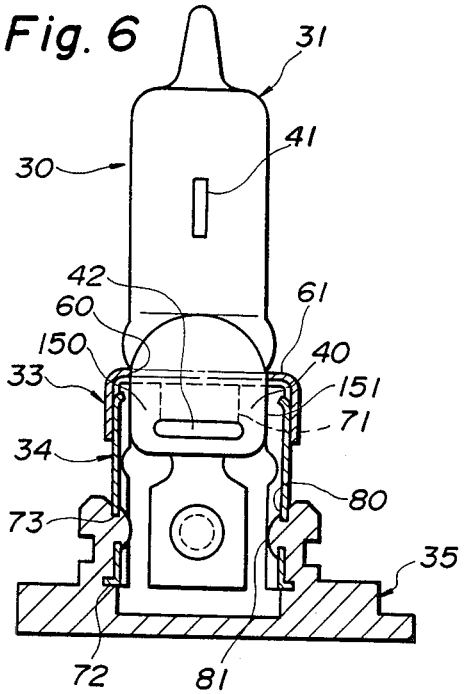

Referring now to FIGS. 4 to 6, an incadescent lamp unit 30 according to the first embodiment of the present invention comprises an incandescent lamp bulb 31 containing a filament 41 and which has a pinched portion 40 of a rectangular section at the rear end thereof, a first metallic base 33 having a plurality of lugs 61 which hold the upper portion of the pinched portion 40, and a second metallic base 34 having a pair of lugs 71 which hold the lower portion of the pinched portion 40, the first base 33 and second base 34 being fixed to each other with the rear face of the top portion 58 of the first base 33 closely attached to the front face of the top portion 70 of the second base 34.

Figure 7:
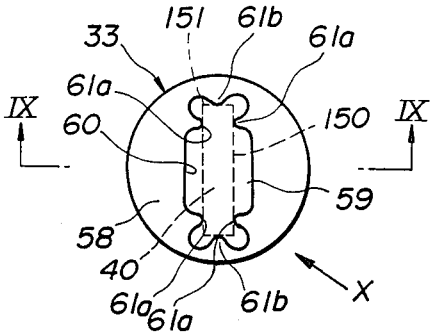
Figure 8:
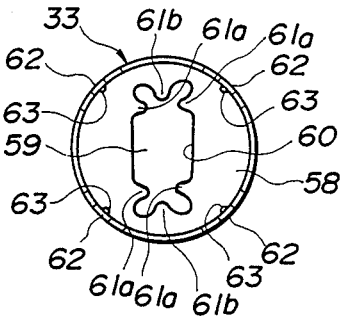
Figure 9:
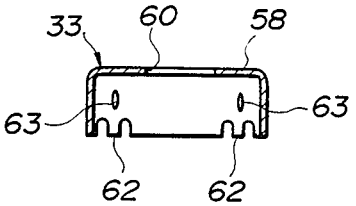
Figure 10:
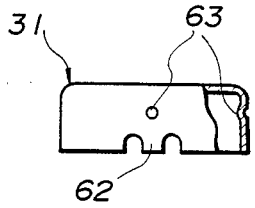

The first base 33 is made of a resilient metal, and it takes the form of a cylinder generally opening downward as shown in FIGS. 7 to 9. The top portion 58 of the first base 33 has formed by punching therein a first opening 59 in which the pinched portion 40 can be introduced. There are formed horizontally along the edges 60 of the opening 59 a plurality of first horizontal lugs 61*a* which engage on the upper opposite ends of the wide side faces 150 of the pinched portion 40 and also a plurality of second horizontal lugs 61*b* which engage the upper center of the narrow side faces 151. Two paris of lugs 61*a* are disposed respectively in postions where they catch the two opposite wide side faces 150 of the pinched portion 40 which is shown as a dash line in FIG. 7, and each pair of lugs 61*a* is disposed in a position adjacent to the opposite narrow side faces 151 of the pinched portion 40. These lugs 61*a* serve to limit the pinched portion 40 from moving in the direction of the width of the latter, that is, laterally. The lugs 61*b* are disposed correspondingly to the two narrow side faces 151, respectively, and limit the pinched portion 40 from moving a direction perpendicular to the direction of the width of the pinch portion 40, namely longitudinally. The first horizontal lugs 61*a* and second horizontal lugs 61*b* form together a first lug means.

As shown in FIGS. 8 and 9, the first base 33 has four engagement pawls 62 formed as regularly spaced circumferentially on the lower end portion thereof. Each of these engagement pawls 62 is formed as a portion between two neighboring cuts each like the half of a round-ended elongated hole, provided in the lower edge of the first cylindrical base 33. Also a protrusion 63 is formed on the inner surface of the body section of the first base 33 correspondingly to each of the engagement pawls 62.

Figure 11:
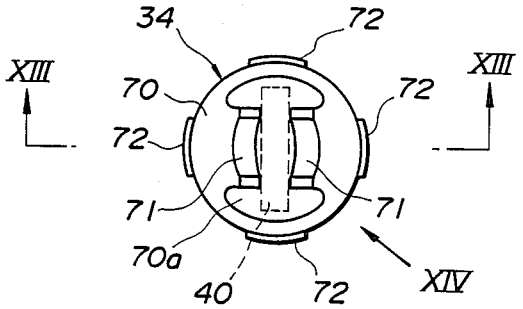
Figure 12:
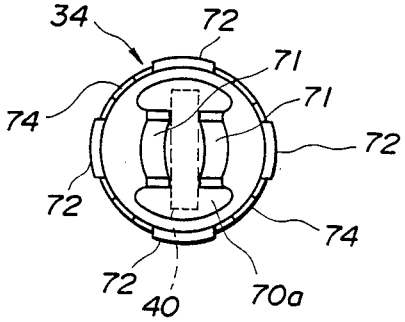
Figure 13:
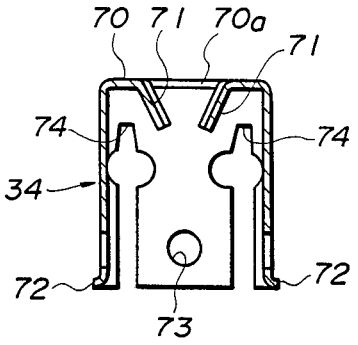
Figure 14:
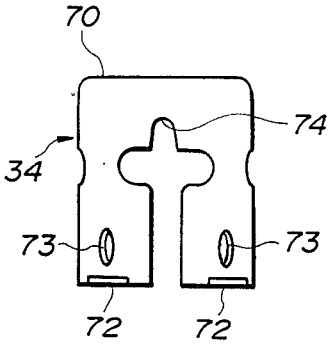

The second base 34 is made of a resilient metal. This second base 34 also takes the form of a cylinder higher than the first base 33 and which is opened at the bottom end thereof. The top portion 70 of the second base 34 has formed by punching therein a second opening 70*a* into which the pinched portion 40 can be introduced. At the edges of the second opening 70*a*, there are formed lugs 71 in pair extending obliquely downward and resiliently engaging the lower portion of the pinched portion 40 as shown imaginarily with dash line in FIGS. 11 and 12. These lugs form a second lug means. The lugs 71 are curved at the central portion thereof and substantially flat at the end portions thereof. These flat end portions resiliently engage the protrusions 42 formed at the lower portion of the pinched portion 40 paralle to the bottom of the latter. The second base 34 has formed as regularly spaced circumferentially at the lower edge thereof four outwardly bent pawls 72, and also there are formed in the circumfenrential surface thereof four circular throughholes 73 correspondingly to and above the pawls 72. Further, there is formed between neighboring pawls 72 a cut 74 cut upwardly from the lower edge of the second base 34. Namely, four such recesses 73 are formed as regularly spaced. The first base 33 is forcibly fitted onto the second cylindrical base 34 against the effect of the small protrusions 63 on the inner surface thereof. With the inner surface of the top portion 58 of the first base 33 closely attached to the outer surface of the top portion 70 of the second base 34, the four pawls 62 of the first base 33 are engaged, by calking, in the upper portions, respectively, of the four cuts 74 in the second base 34. Owing to this calking, the first base 33 is securely fixed to the second base 34.

The reference numeral 35 indicates a holder made of a synthetic resin which has a circular hole 80 into which the second base 34 assembled to the first base 33 can be inserted. Also, this holder 35 has terminals (not shown) to which the lead wired led out of the pinched portion are to be connected. The lower end of the second base 34 is inserted in the circular hole 80 in the holder 35 and securely fixed to the holder 35 made of a synthetic resin by means of ultrasonic welding or any other method. More particularly, a part of the holder 35 which is softened due to the ultrasonic heating, goes into the second base 34 through the four through-holes 73 therein and is set there over the through-holes 73 to form a fixture 81 as shown in FIGS. 5 and 6. Also, the pawls 72 of the second base 34 catches the circumferential wall of the circular hole 80 in the holder 35 softened by the ultrasonic heating, and when the part of the holder 35 is set, the pawls 72 are rigidly held by the holder 35.

While the pinched portion 40 of the bulb 31 is introduced into the first opening 59 in the first base 33 and the second opening 70*a* in the second base 34. The first horizontal lugs 61*a* formed on the first base 33 abut the upper portion of the opposite wide side faces 150 and the second horizontal lugs 61*b* formed on the first base 33 abut the upper portion of the narrow side faces 151. The obliquely extending lugs 71 in pair formed on the second base 34 are resiliently engaged on the protrusions 42, respectively, formed on the lower portion of the wide side faces in pair. Thus, the pinched portion 40 has the upper portion thereof limited by the first and second horizontal lugs 61*a* and 61*b* of the first base 33 from moving in the horizontal plane, and the lower portion thereof limited by the pair of obliquely extending lugs 71 of the second base 34 from moving in the vertical plane, namely, from tilting. The width of the lug 71, namely, the length of the bent portion to the end from the top portion 70 of the second base 34, can be selected independently of the width of the pinched portion 40, namely, the distance between the wide side faces. So it is possible to extend the end of the lug 71 to the bottom of the pinched portion 40 to provide a sufficient length of the arm.

As is apparent from FIG. 4, according to this embodiment, the first horizontal lugs 61*a* of the second base 33 and the obliquely extending lugs 71 of the second base 34 are positioned in a staggered relation; namely, the first horizontal lugs 61*a* are positioned correspondingly to the positions somewhat outer from both sides of one downwardly extending oblique lug 71. The four first horizontal lugs 61*a* are all extended horizontally, but in case the width of the pinched portion 40 of the bulb 31 is larger than the distance between the two opposite first horizontal lugs 61*a* because of the clearance in the production process of the bulb 31, the first horizontal lug 61*a* can be engaged on the upper portion of the wide side face 150 of the pinched portion 40 while being somewhat depressed downwardly by the pinched portion 40. In this case, even if the first horizontal lug 61*a* is bent downwardly, it will be positioned outside the both sides of the obliquely extending lug 71, so that the lug 61*a* will not touch the lug 71.

Figure 15:
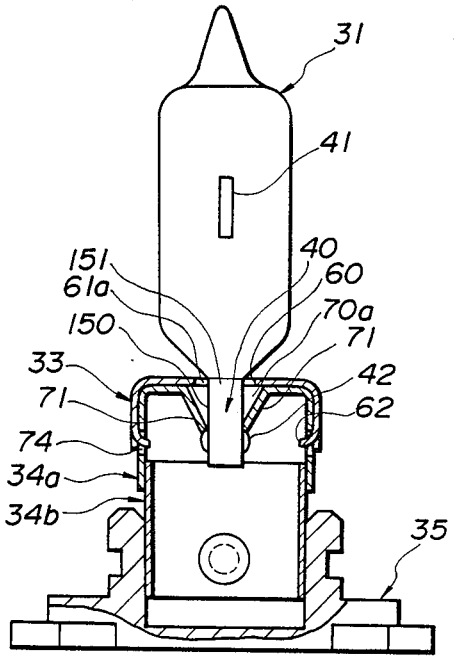
Figure 16:
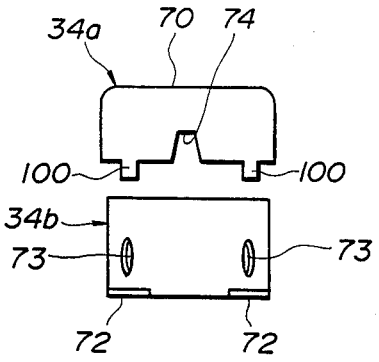
Figure 17:
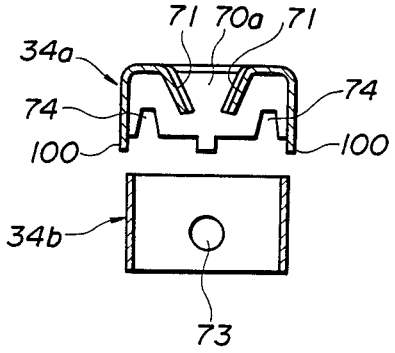

FIGS. 15 to 17 show a variant of the aforementioned embodiment of the present invention. In these Figures, the same or like numerals indiate the same or like elements.

In this variant, the second base 34 is of a two-part structure, and composed of an upper base piece 34*a* to be fixed to the first base 33 and a lower base piece 34*b* which is to be fixed to the holder 35. The upper base piece 34a has formed, by punching, in the top portion thereof a pair of lugs 71 and also an opening 70*a* in which the pinched portion 40 can be introduced. Furthermore, the upper base piece 70 has formed at the lower end thereof joints 100 for connection with the lower base piece 34*b*. Also, the upper base piece 3 34*a* has also formed therein cuts 74 corresponding to the cuts in the aforementioned embodiment and in which the pawls 62 of the first base 33 are engaged by calking. The lower base piece 34*b* takes the form of a small cylinder of which the outside diameter is generally equal to or slightly smaller than the inside diameter of the upper base piece 34*a*, and has formed at the lower portion thereof pawls 72 and through-holes 73 corresponding to those in the aforementioned embodiment. FIGS. 16 and 17 show the above-mention upper and lower base piece 34*a* and 34*b*, not the first base 33.

The first base 33 has the pawls 62 thereof engaged, by calking, in the cuts 74 in the upper base piece 34*a*, and the upper base piece 34*a* has the lower end thereof fitted on the upper end of the lower base piece 34*b*. The depth of the upper base piece 34*a* onto the lower base piece 34*b* is so adjusted that the filament is located in position, and thereafter the joints 100 of the upper base piece 34*a* are fixed to the outer circumference of the lower base piece 34*b* by welding or otherwise. Because it has already been described in the explanation of the first embodiment, the mounting of the bulb 31 to the first and second bases 33 and 34 will not be further described here. In the variant having been explained in the foregoing, the second base 34 is of a two-part structure having the upper and lower base pieces 34*a* and 34*b* and the filament 41 can be located in position by adjusting the position vertically.

Figure 18:
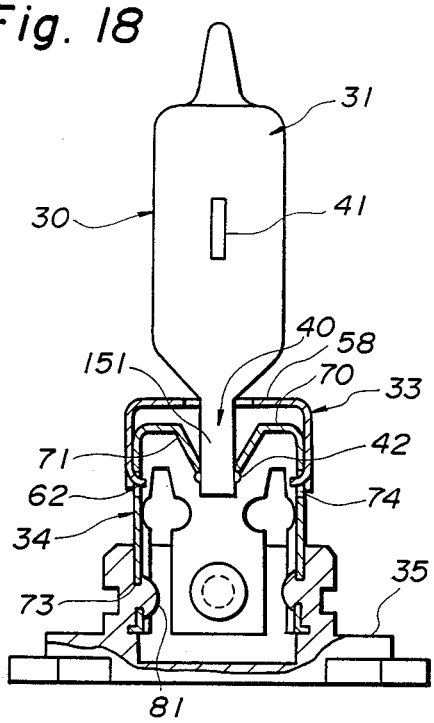
FIGS. 18 and 19 are axial sectional views, respectively, of antoher variant of the present invention, corresponding to FIGS. 5 and 6 of the first embodiment, showing that the upper and lower portions of the second base are disposed as spaced from each other in the direction in which the pinched portion is introduced into the base assembly.
Figure 19:
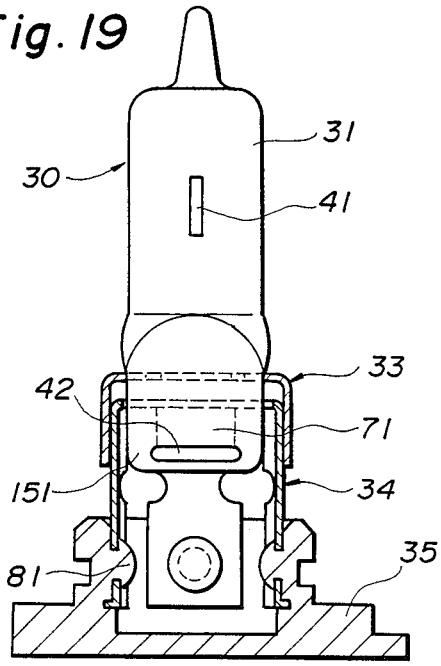

FIGS. 18 and 19 show another variant of the aforementioned embodiment of the present invention. In these Figures, same or like numerals indicate the same or like elements.

In this second variant, the first base 33 and second base 34 are vertically spaced from each other. Namely, with the top portion 58 of the first base 33 spaced from the top portion 70 of the second base 34, the engagement pawls 62 at the lower end of the first base 33 can be engaged in the cuts 74 formed in the second base 34 by calking. Because of this arrangement, the distance from the top portion of the first base 33 to the end of the obliquely extending lug 71, namely, the arm length of the obliquely extending lug 71, can be increased so that the pinched portion 40 of the bulb 31 can be held stably.

What is claimed is:

1. An incandescent lamp unit provided with a metallic base assembly and destined for use as an automotive headlight, comprising a bulb having provided at the rear end thereof a pinched portion of a rectangular section which has two opposite wide side faces and two opposite narrow side faces, said pinched portion being supported by a plurality of lugs formed on the metallic base assembly, said base assembly comprising a first base having formed therein a first opening in which said pinched portion is introduced and provided with a pair of first lug members extending along edges of said first opening and which abut an upper portion of said pinched portion, and a second base attached to said first base, having formed therein a second opening in which said pinched portion is introduced and also provided with a pair of second lug members extending along edges of said second opening and which abut a lower portion of said pinched portion, said second base being so arranged as to be fixed to a holder, said first lug members include at least two pairs of first horizontal lugs which abut said wide side faces, respectively, in pair and limit said pinched portion from moving laterally, and at least one pair of second horizontal lugs which abut said narrow side faces, respectively, in pair and limit said pinched portions from moving longitudinally, and in which said second lug members include at least one pair of lugs extending obliquely and downwardly from the edges of said second opening and which abut said wide side faces, respectively, in pair and limit said pinched portion from tilting.

2. An incandescent lamp unit according to claim 1, in which said first horizontal lugs of said first lug members are formed in positions outside longitudinal ends of the oblique lugs of said second lug members.

3. An incandescent lamp unit according to claim 1, in which said second base is of a two-part structure comprising an upper base piece on which said second lug members are formed and a lower base piece which is adjustably attached to said upper base piece and fixed to said holder.

4. An incandescent lamp unit according to claim 1, in which said first base is attached to said second base with a predetermined spacing from the latter.

* * * * *